US009364940B2

(12) United States Patent
Wu

(10) Patent No.: US 9,364,940 B2
(45) Date of Patent: Jun. 14, 2016

(54) MULTI-MODE WRENCH

(71) Applicant: Yi-Min Wu, Taichung (TW)

(72) Inventor: Yi-Min Wu, Taichung (TW)

( * ) Notice: Subject to any disclaimer, the term of this patent is extended or adjusted under 35 U.S.C. 154(b) by 373 days.

(21) Appl. No.: 14/108,342

(22) Filed: Dec. 17, 2013

(65) Prior Publication Data

US 2015/0165600 A1 Jun. 18, 2015

(51) Int. Cl.
*B25B 13/46* (2006.01)
*B25B 13/48* (2006.01)

(52) U.S. Cl.
CPC ..... *B25B 13/463* (2013.01); *B25B 13/481* (2013.01)

(58) Field of Classification Search
CPC .... B25B 13/462; B25B 13/463; B25B 13/481
See application file for complete search history.

(56) References Cited

U.S. PATENT DOCUMENTS 4,794,993 A * 1/1989 Swenson ..... B25B 13/462 173/93.5
6,397,705 B1 * 6/2002 Hsieh ..... B25B 15/04 192/43.2
9,038,507 B2 * 5/2015 Thompson ..... B25B 13/463 81/62
9,067,308 B2 * 6/2015 Lai ..... B25B 13/462 81/63.1
9,079,299 B2 * 7/2015 Wu ..... B25B 13/463 81/63.1
2012/0167723 A1 * 7/2012 Gapp ..... B25B 13/08 81/62

* cited by examiner

*Primary Examiner* — David B Thomas

(57) ABSTRACT

A multi-mode one-way wrench includes a handle, a toothed wheel, two pawls and a switch. The handle is formed with a head and two grooves. The toothed wheel is rotationally placed in the head and formed with teeth. The first pawl is movably placed in the first groove for engagement with the toothed wheel. The second pawl is movably placed in the second groove for engagement with the toothed wheel when the first pawl is disengaged from the first pawl. The switch is operable for moving the second pawl between a first mode for engagement with the toothed wheel and a second mode kept from engagement with the toothed wheel. The first groove is biased from the second groove by an angle of 360°×(M+½)÷N, wherein N is an integer that represents the number of the teeth and M is any proper integer.

10 Claims, 7 Drawing Sheets

MULTI-MODE WRENCH

BACKGROUND OF INVENTION

1. Field of Invention

The present invention relates to a one-way wrench and, more particularly, to a multi-mode one-way wrench.

2. Related Prior Art

A one-way wrench (or "ratchet wrench") includes a hollow head, a toothed wheel placed in the head, and a pawl placed in the head. As the head is rotated in an active direction, the pawl is engaged with the toothed wheel so that the head rotates the toothed wheel via the pawl. As the head is rotated in an idle direction, the pawl is allowed to rattle on the toothed wheel so that the head does not rotate the toothed wheel in the idle direction.

In operation, the toothed wheel is engaged with a nut for example. The head is rotated in the active direction to rotate the toothed wheel for an angle, and the head is rotated in the idle direction for an adequate angle before the head is rotated in the active direction again to rotate the wheel. This process is repeated so that the nut is engaged with a screw or removed from a screw. Such a one-way wrench is particularly useful in a limited space.

The head must be rotated in the idle direction for at least a minimum angle before the head can rotate the toothed wheel in the active direction again. The more the teeth of the toothed wheel are, the smaller the minimum angle is, i.e., the more convenient the operation of the one-way wrench is. For example, the minimum angle is 10° where the toothed wheel includes 36 teeth but only 5° where the toothed wheel includes 72 teeth. However, the more the teeth are, the smaller and hence weaker they are. It is difficult to increase the convenience without jeopardizing the strength in a conventional one-way wrench.

To reach a good balance between the convenience and strength, the applicant has invented a one-way wrench and filed applications such as European Patent Application No. 12195169.3, U.S. patent application Ser. No. 13/691,477, Japanese Patent Application 2013-170474, Chinese Patent Application no. 201210507001.6 and Taiwanese Patent Application No. 101139643.

Therefore, the present invention is intended to obviate or at least alleviate the problems encountered in prior art.

SUMMARY OF INVENTION

It is the primary objective of the present invention to provide a multi-mode one-way wrench.

To achieve the foregoing objective, the multi-mode one-way wrench includes a handle, a toothed wheel, two pawls and a switch. The handle includes a head and two grooves. The toothed wheel is rotationally placed in the head and formed with teeth. The first pawl is movably placed in the first groove for engagement with the toothed wheel. The second pawl is movably placed in the second groove for engagement with the toothed wheel when the first pawl is disengaged from the first pawl. The switch is operable for moving the second pawl between a first mode for engagement with the toothed wheel and a second mode kept from engagement with the toothed wheel. The first groove is biased from the second groove by an angle of $360° \times (M+½) \div N$, wherein N is an integer that represents the number of the teeth and M is any proper integer.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
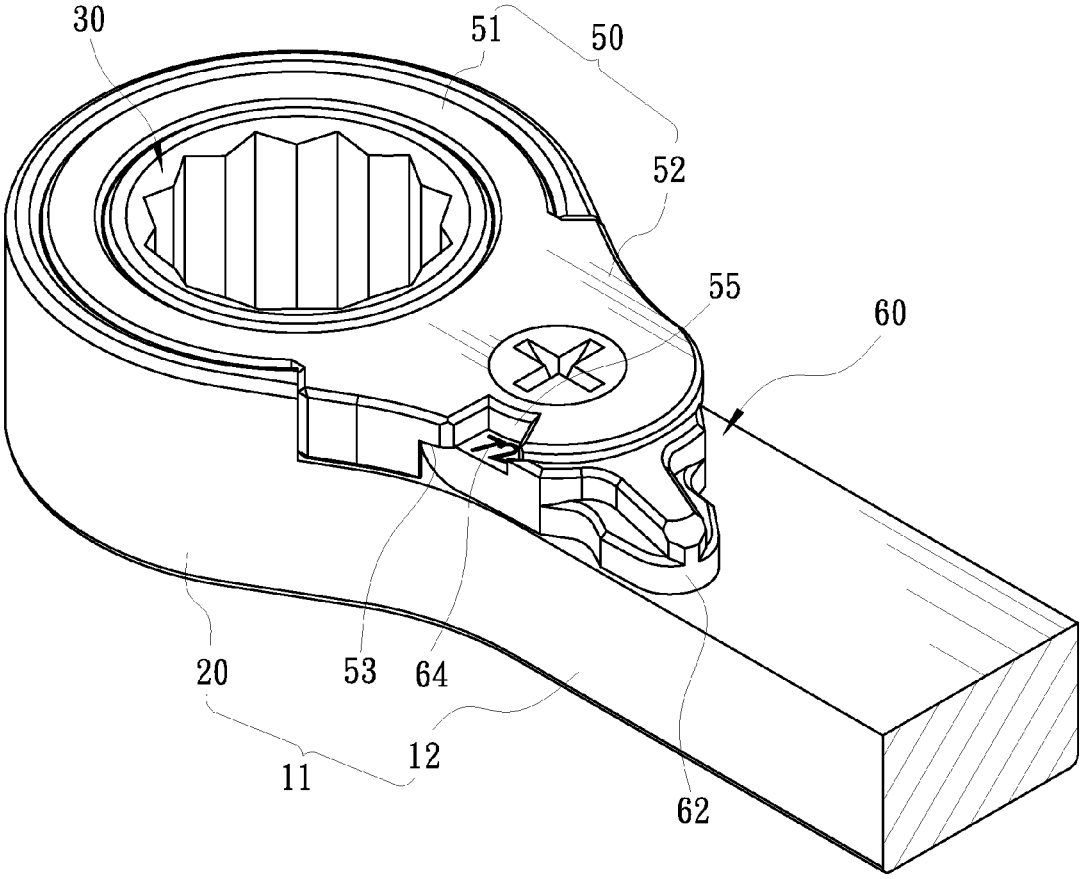
FIG. 1 is a perspective view of a convenient and strong multi-mode one-way wrench according to the preferred embodiment of the present invention.
Figure 2:
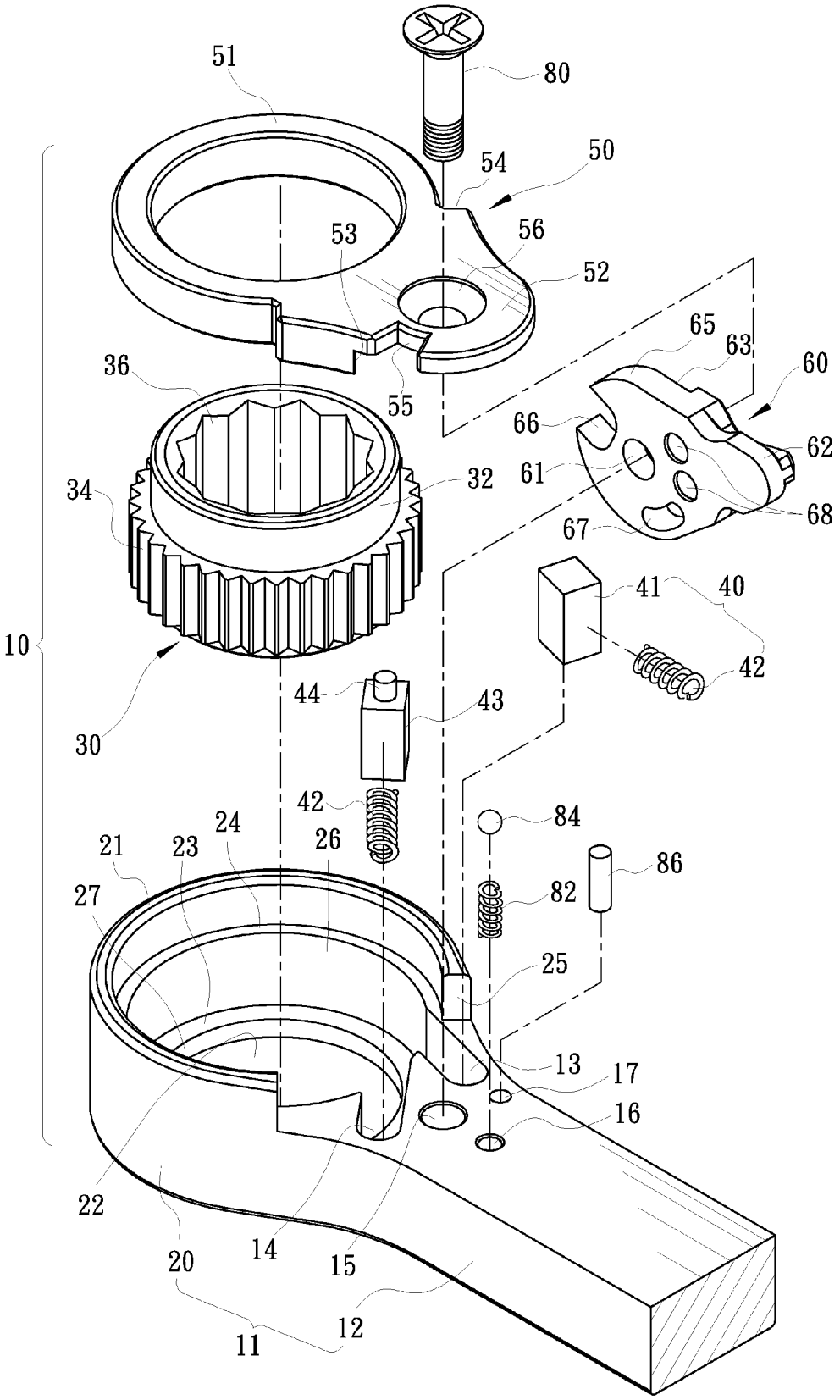
FIG. 2 is an exploded view of the multi-mode one-way wrench shown in FIG. 1.
Figure 3:
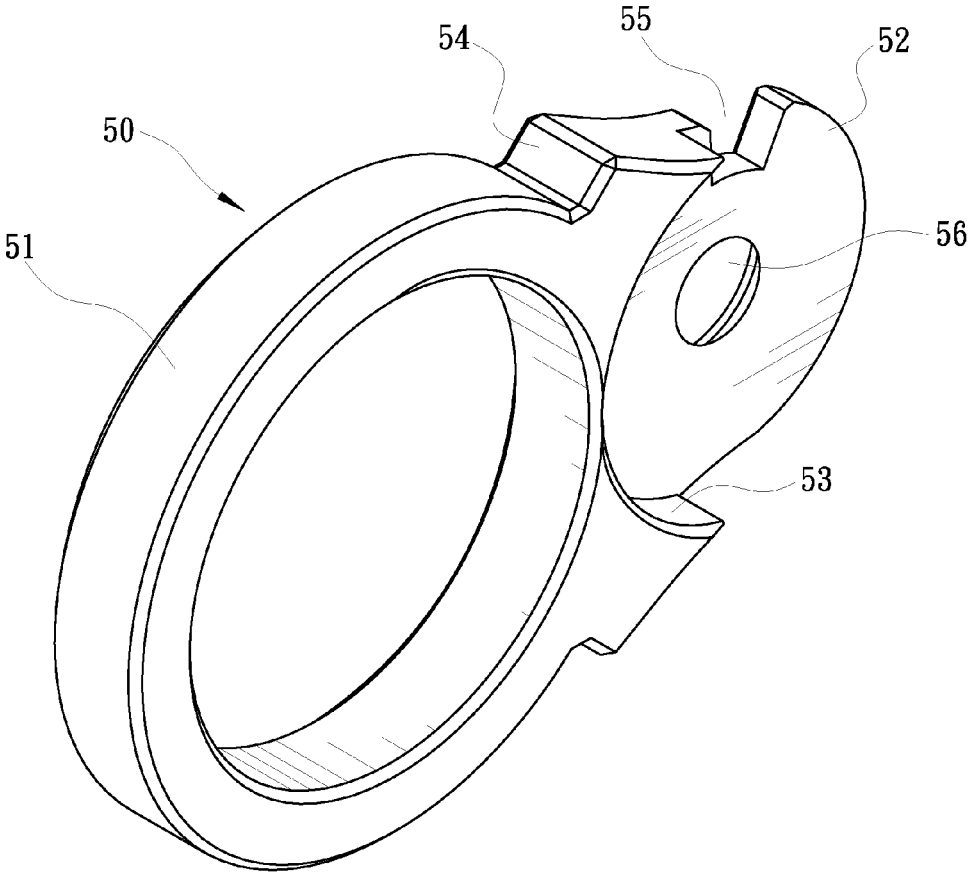
FIG. 3 is a perspective view of a cover of the multi-mode one-way wrench shown in FIG. 1.
Figure 4:
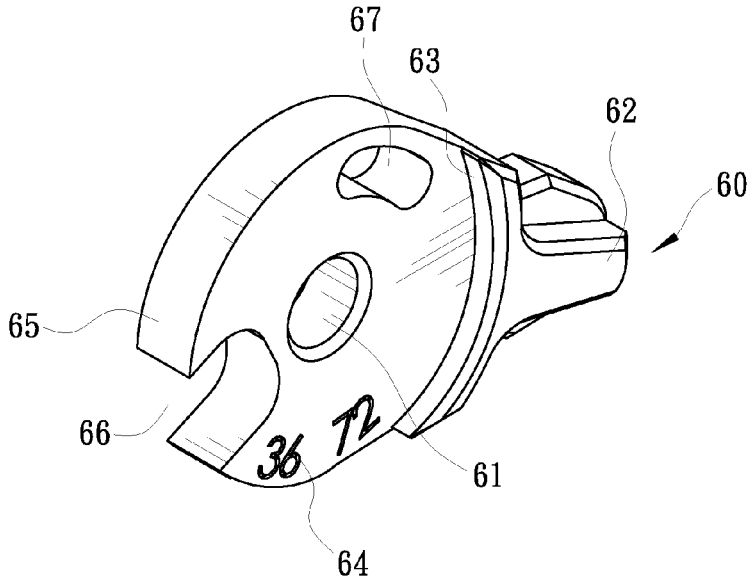
FIG. 4 is another perspective view of the cover shown in FIG. 3.

Referring to FIGS. 1 to 4, there is a multi-mode one-way wrench 10 according to the preferred embodiment of the present invention. The multi-mode one-way wrench 10 includes a handle 11, a toothed wheel 30, a pawl unit 40, a cover 50 and a switch 60. The handle 11 includes an enlarged hollow head 20 formed at an end of a grip 12. The grip 12 is formed with two grooves 13 and 14, a screw hole 15 and two bores 16 and 17 near the head 20. The groove 13 extends along a centerline biased from that of the groove 14 by an angle of $360° \times (M+½)/N$, wherein N is an integer that represents the number of the teeth 34 and M is any proper integer.

The head 20 includes a primary wall 26, an extensive wall 21 extending from an upper edge of the primary wall 26, and a flange 27 extending from an internal side of the primary wall 26. The extensive wall 21 is a C-shaped element with two ends 25. The thickness of the extensive wall 21 is smaller than that of the primary wall 26 so that there is a shoulder 24 between the extensive wall 21 and the primary wall 26. There is shoulder 23 between the primary wall 26 and the flange 27. The primary wall 26, the extensive wall 21 and the flange 27 together make a stepped space 22. The stepped space 22 is in communication with the grooves 13 and 14.

The toothed wheel 30 is formed with two axles 32, teeth 34 and a non-circular aperture 36. One of the axles 32 (the "lower axle") extends from a lower side of the toothed wheel 30 while the other axle 32 (the "upper axle") extends from an upper side of the toothed wheel 30. The teeth 34 extend from the periphery of the toothed wheel 30 in a radial manner. The non-circular aperture 36 axially extends throughout the toothed wheel 30 including the axle 32.

In the preferred embodiment, there are 36 (thirty-six) teeth 34 each covering an angle of 10°. The angle between the centerline of the groove 13 and that of the groove 14 is 35° for example.

The pawl unit 40 includes two pawls 41 and 43 and two springs 42. The pawls 41 and 43 are both in the form of a cuboid. The pawl 43 includes a stem 44 extending from an upper end.

The cover 50 includes a ring 51, a tab 52 extending from the ring 51, and two shoulders 54 formed between the ring 51 and the tab 52. The thickness of the ring 51 is larger than that of the tab 52 so that there is a shoulder 53 between the ring 51 and the tab 52. The shoulder 53 extends along in an arc. The tab 52 includes a window 55 and a countersink hole 56.

The switch 60 includes a lever 62 at an end and two claws 65 at an opposite end. The switch 60 further includes an aperture 61 axially made therein, a cutout 66 between the claws 65, and a slot 67 extending about the aperture 61. The switch 60 further includes two recesses 68 in a lower side and a marking unit 64 on an upper side. For example, the marking unit 64 includes two numbers "36" and "72" to represent a 36-teeth mode and a 72-teeth mode respectively.

The toothed wheel 30 is placed in the stepped space 22. The lower axle 32 is inserted in an opening around which the flange 27 extends. The flange 27 is used as a bearing for the lower axle 32. The teeth 34 are supported on the shoulder 23.

The pawl 41 and one of the springs 42 (the "first spring") are placed in the groove 13. The first spring 42 is compressed between the pawl 41 and a closed end of the groove 13. Thus, the first spring 42 tends to push the pawl 41 into engagement with at least one of the teeth 34, out of an open end of the groove 13.

The pawl 43 and the other spring 42 (the "second spring") are placed in the groove 14. The second spring 42 is compressed between the pawl 43 and a closed end of the groove 14. Thus, the second spring 42 tends to push the pawl 41 into engagement with at least one of the teeth 34, out of an open end of the groove 14.

A spring 82 and a ball 84 are sequentially placed in the bore 16. The spring 82 is compressed between the ball 84 and a closed end of the bore 16. Thus, the spring 82 tends to push the ball 84 out of an open end of the bore 16. A rod 86 is fit in the bore 17.

The switch 60 is placed on the grip 12. The ball 84 is placed in one of the recesses 68. The rod 86 is inserted in the slot 67. The stem 44 is placed in the cutout 66.

The cover 50 is placed on the handle 11. The ring 51 is placed on the shoulder 24 and confined in the extensive wall 21. The shoulders 54 are in contact with the ends 25 of the extensive wall 21 respectively. The upper axle 32 is inserted in an opening around which the ring 51 extends. The ring 51 is used as a bearing for the upper axle 32. The tab 52 is placed on the claws 65 and confined in a cavity 63 made in the switch 60. A screw 80 is inserted in the screw hole 15 through the countersink hole 56 and the aperture 61.

Figure 5:
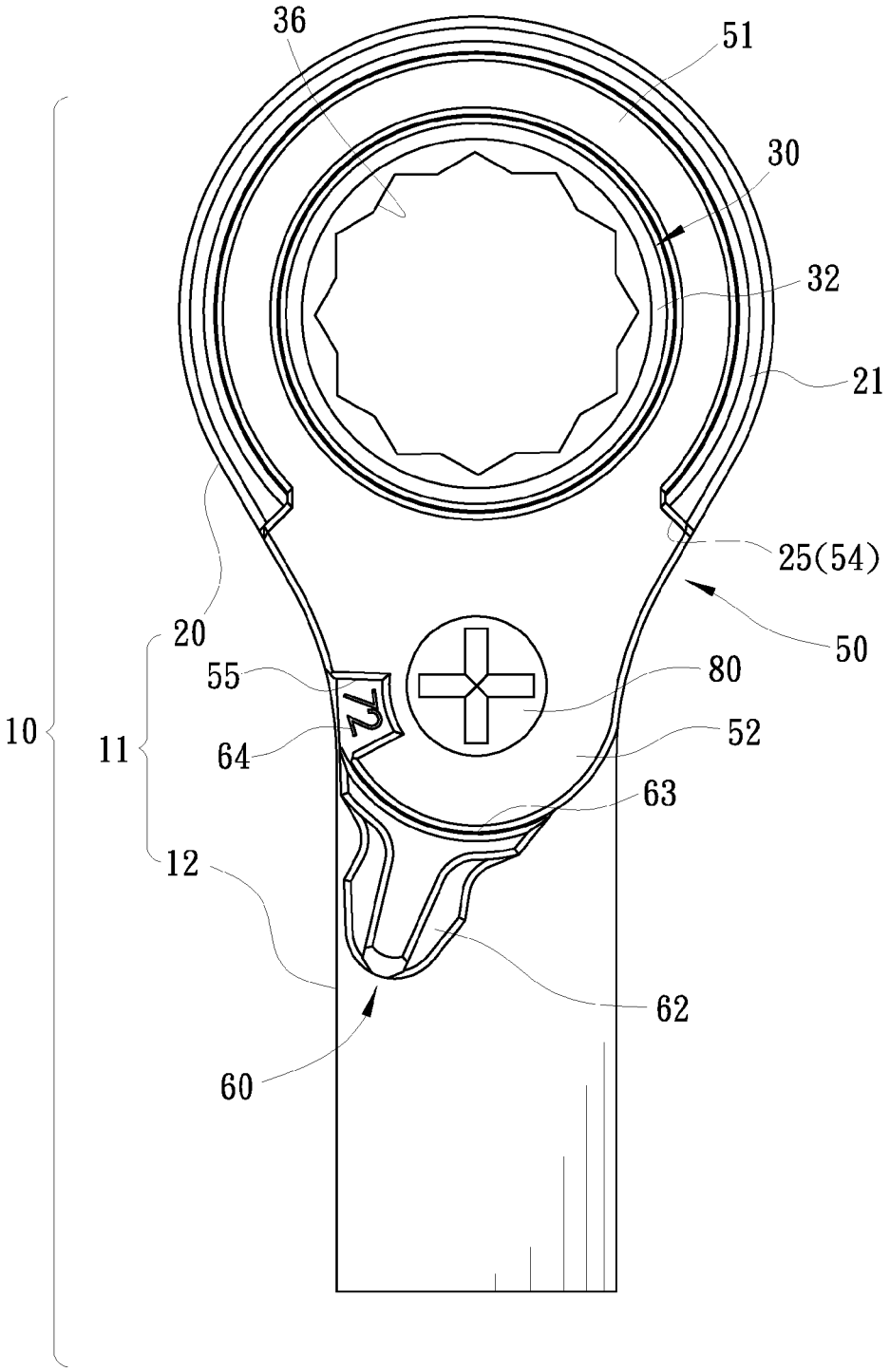
FIG. 5 is a top view of the multi-mode one-way wrench shown in FIG. 1.
Figure 6:
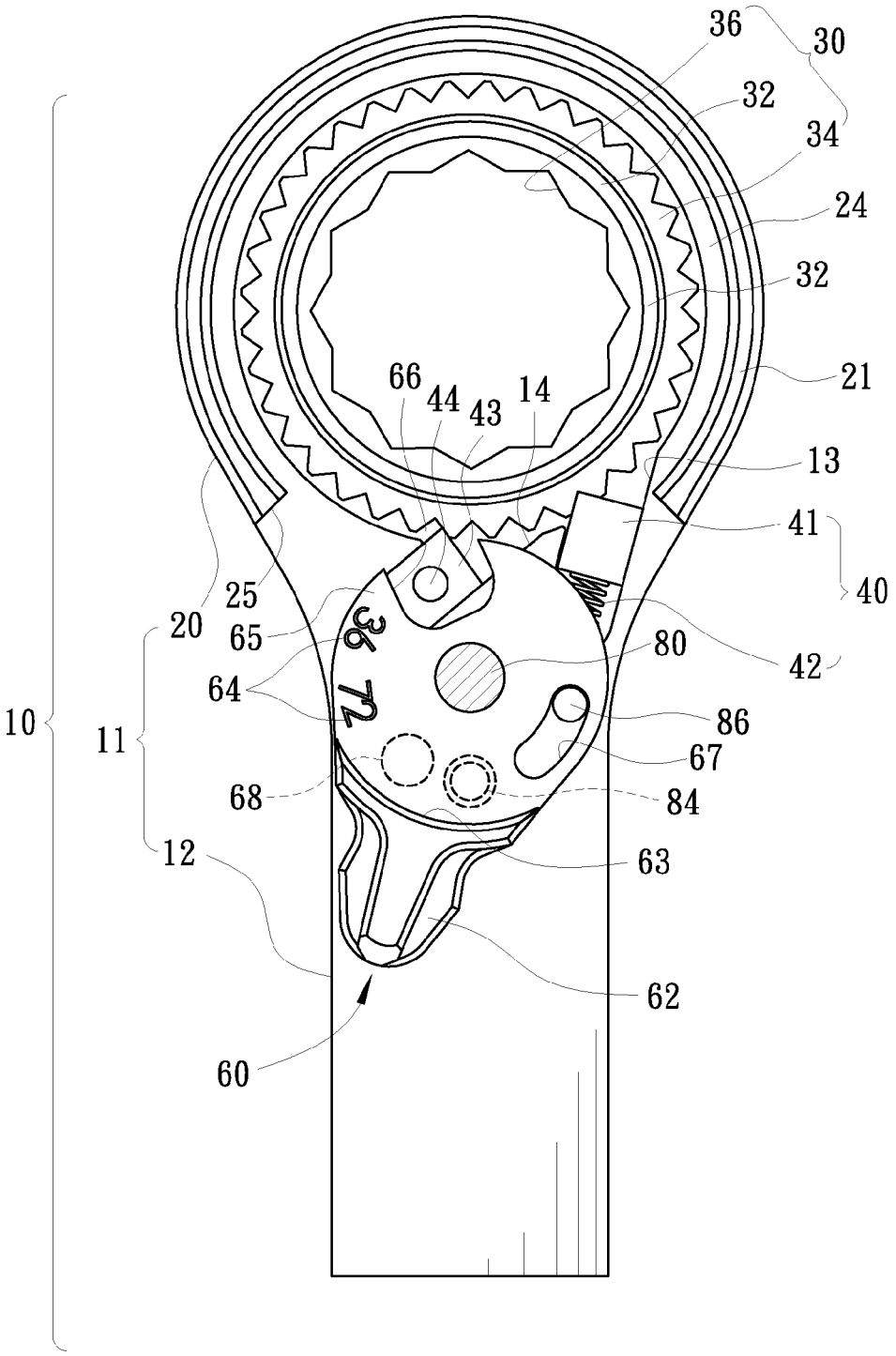
FIG. 6 is a top view of the multi-mode one-way wrench shown in FIG. 5 without the cover shown in FIGS. 3 and 4.

Referring to FIGS. 5 and 6, the multi-mode one-way wrench 10 is in the 72-teeth mode, and the number "72" is accordingly visible through the window 55. In the 72-teeth mode, the pawl 43 is allowed to engage with the teeth 34 as the stem 44 is allowed to move in the cutout 66. The pawl 41 is allowed to engage with the teeth 34. A left side of the pawl 41 is in contact with a right side of one of the teeth 34. The handle 11 is pivoted clockwise to rotate the toothed wheel 30 since the head 20 pushes a right side of the pawl 41 and the left side of the pawl 41 pushes the right side of the tooth 34. Then, the handle 11 is pivoted counterclockwise for half of the angle of one tooth 34, i.e., 5°, so that the left side of the pawl 43 is in contact with a right side of another tooth 34. Again, the handle 11 is pivoted clockwise to rotate the toothed wheel 30 since the head 20 pushes a right side of the pawl 43 and the left side of the pawl 43 pushes the right side of the tooth 34. The ball 84 is placed in one of the recesses 68 to keep the multi-mode one-way wrench 10 in the 72-teeth mode in an elastic manner.

Figure 7:
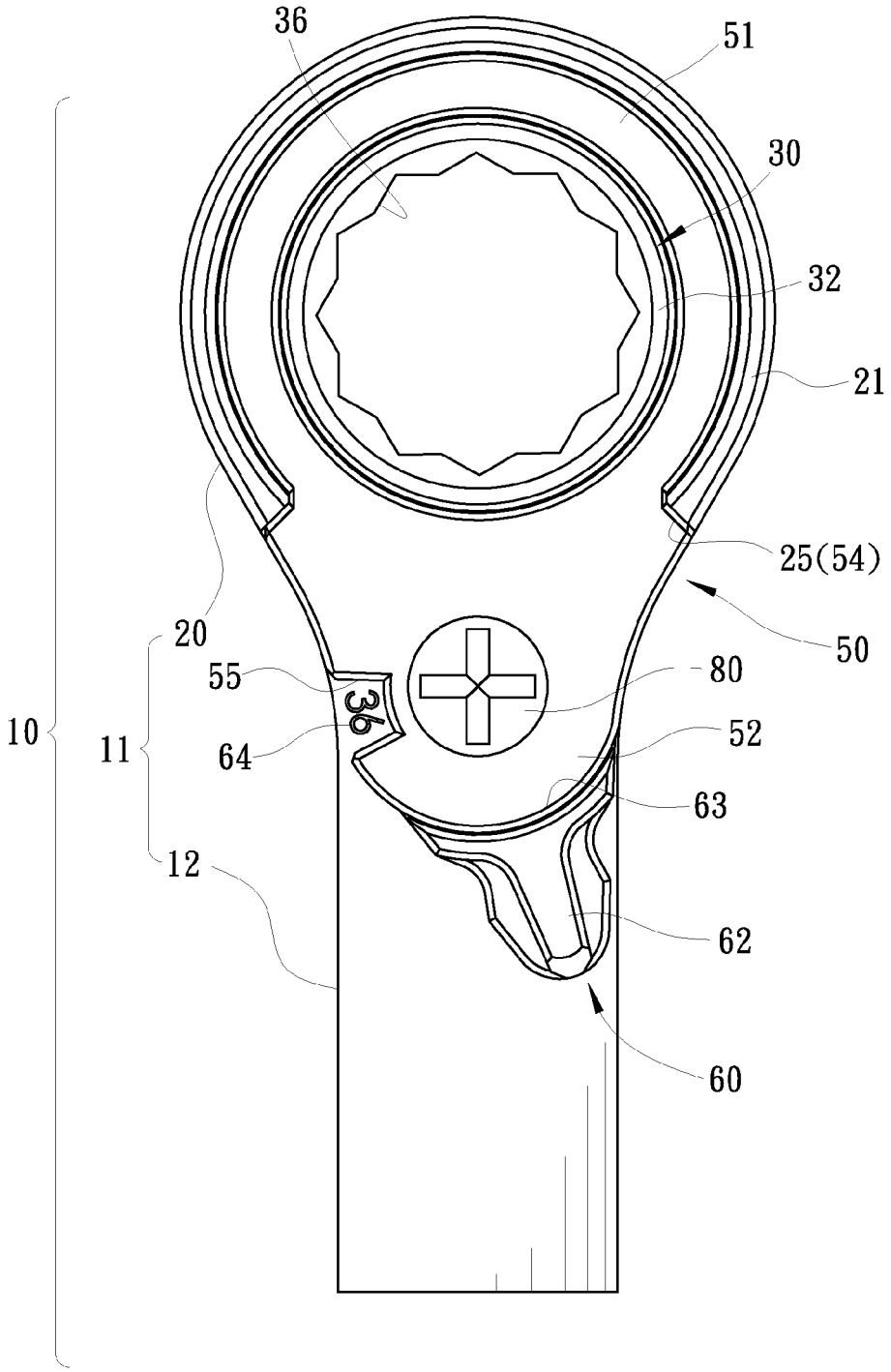
FIG. 7 is a top view of the multi-mode one-way wrench in another position than shown in FIG. 5.
Figure 8:
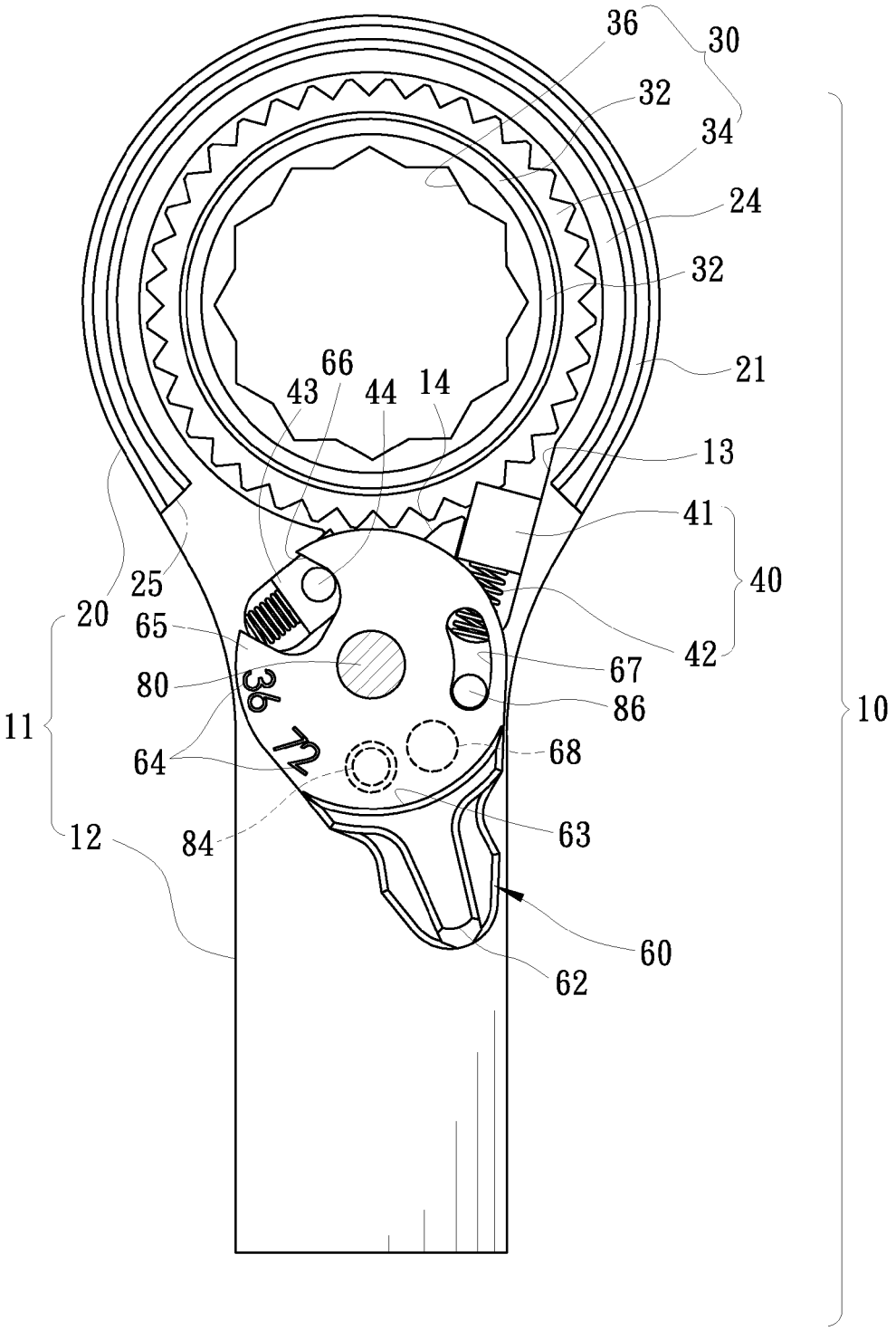
FIG. 8 is a top view of the multi-mode one-way wrench shown in FIG. 7 without the cover shown in FIGS. 3 and 4.

Referring to FIGS. 7 and 8, the multi-mode one-way wrench 10 is in the 36-teeth mode, and the number "36" is accordingly visible through the window 55. In the 36-teeth mode, the pawl 43 is prevented from engagement with the teeth 34 as the stem 44 is restrained by one of the claws 65. The pawl 41 is allowed to engage with the teeth 34. The left side of the pawl 41 is in contact with a right side of one of the teeth 34. The handle 11 is pivoted clockwise to rotate the toothed wheel 30 since the head 20 pushes a right side of the pawl 41 and the left side of the pawl 41 pushes the right side of the tooth 34. Then, the handle 11 is pivoted counterclockwise for the angle of one tooth 34, i.e., 10°, so that the left side of the pawl 41 is in contact with a right side of another tooth 34. Again, the handle 11 is pivoted clockwise to rotate the toothed wheel 30 since the head 20 pushes a right side of the pawl 41 and the left side of the pawl 41 pushes the right side of the tooth 34. The ball 84 is placed in the other recess 68 to keep the multi-mode one-way wrench 10 in the 36-teeth mode in an elastic manner.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A multi-mode one-way wrench including:

a handle formed with a head, a first groove and a second groove;

a toothed wheel rotationally placed in the head and formed with teeth;

a first pawl movably placed in the first groove for engagement with the toothed wheel;

a second pawl movably placed in the second groove for engagement with the toothed wheel when the first pawl is disengaged from the first pawl; and a switch operable for moving the second pawl between a first mode for engagement with the toothed wheel and a second mode kept from engagement with the toothed wheel, wherein the first groove is biased from the second groove by an angle of $360° \times (M+½) \div N$, wherein N is an integer that represents the number of the teeth and M is any proper integer.

2. The multi-mode one-way wrench according to claim 1, including a first spring placed in the first groove to bias the first pawl toward the toothed wheel and a second spring placed in the second groove to bias the second pawl toward the toothed wheel.

3. The multi-mode one-way wrench according to claim 1, wherein the second pawl is formed with a stem, wherein the switch includes a claw for contact with the stem to keep the second pawl in the second mode.

4. The multi-mode one-way wrench according to claim 1, including a ball placed on the handle, wherein the switch includes a first recess for receiving the ball as the second pawl is in the first mode and a second recess for receiving the ball as the second pawl is in the second mode.

5. The multi-mode one-way wrench according to claim 4, wherein the handle includes a bore for receiving the ball.

6. The multi-mode one-way wrench according to claim 5, including a spring placed in the bore to bias the ball.

7. The multi-mode one-way wrench according to claim 1, wherein the switch is pivotally connected to the handle.

8. The multi-mode one-way wrench according to claim 7, including a rod connected to the handle, wherein the switch includes an arched slot for receiving the rod to ensure smooth pivoting of the switch on the handle.

9. The multi-mode one-way wrench according to claim 1, including a cover connected to the handle to keep the toothed wheel in the head and the switch on the handle.

10. The multi-mode one-way wrench according to claim 9, wherein the switch is formed with a first mark and a second mark, wherein the cover includes a window for revealing the first mark as the second pawl is in the first mode and revealing the second mark as the second pawl is in the second mode.

* * * * *